US006568904B1

(12) United States Patent
Ueyama et al.

(10) Patent No.: US 6,568,904 B1
(45) Date of Patent: May 27, 2003

(54) FLUIDAL MACHINE

(75) Inventors: Yoshiharu Ueyama, Tsukuba (JP); Michiyuki Takagi, Ushiku (JP); Yasushi Takano, Ibaraki-ken (JP); Yukiji Iwase, Ushiku (JP); Michiaki Ida, Tsuchiura (JP); Sadashi Tanaka, Ibaraki-ken (JP); Yoshihiro Nagaoka, Ishioka (JP); Tetsuya Yoshida, Tsuchiura (JP)

(73) Assignees: Hitachi, Ltd., Tokyo (JP); Hitachi Techno Engineering Co., Ltd., Tokyo (JP)

( * ) Notice: Subject to any disclaimer, the term of this patent is extended or adjusted under 35 U.S.C. 154(b) by 0 days.

(21) Appl. No.: 08/514,255

(22) Filed: Aug. 11, 1995

(30) Foreign Application Priority Data

Sep. 20, 1994 (JP) ..... 6-224773

(51) Int. Cl.[7] ..... F04D 29/44
(52) U.S. Cl. ..... 415/199.2
(58) Field of Search ..... 415/199.1, 199.2, 415/199.3, 214.1

(56) References Cited

U.S. PATENT DOCUMENTS

| | | | | |
|---|---|---|---|---|
| 2,450,143 A | | 9/1948 | Howard et al. | |
| 3,801,217 A | * | 4/1974 | Ryall et al. | 415/214.1 |
| 3,927,763 A | | 12/1975 | Strub et al. | |
| 4,218,181 A | | 8/1980 | Komatsu et al. | |
| 4,804,211 A | | 2/1989 | Larsen et al. | |
| 4,848,409 A | | 7/1989 | Jahnke, Jr. | |
| 5,133,638 A | | 7/1992 | Mosure | |
| 5,207,560 A | * | 5/1993 | Urban | 415/199.1 |
| 5,456,577 A | * | 10/1995 | O'Sullivan et al. | 415/199.2 |

FOREIGN PATENT DOCUMENTS

| | | | | |
|---|---|---|---|---|
| CH | 583855 | | 1/1977 | |
| DE | 964020 | * | 5/1957 | 415/199.2 |
| DE | 1092770 | * | 11/1960 | 415/199.2 |
| DE | 2111171 | | 9/1972 | |
| DE | 2330286 | | 1/1974 | |
| EP | 0010216 | | 4/1980 | |
| EP | 0039459 | | 11/1981 | |
| EP | 199097 | | 10/1986 | |
| EP | 0573895 | | 12/1993 | |
| FR | 1513952 | | 2/1968 | |
| GB | 2129494 | * | 5/1984 | 415/214.1 |
| JP | 58-144689 | | 8/1983 | |
| JP | 60-151530 | | 8/1985 | |
| JP | 6-33891 | | 2/1994 | |
| NL | 7909135 | | 7/1981 | |

OTHER PUBLICATIONS

"Kagen Kyokai Kohza 1. Pump," Karyoku–genshiryokuhatsuden–gijutsu–kyokai, Apr. 1988, pp. 23–25.
Search Report for EP 95113297, dated Feb. 9, 1998.

* cited by examiner

*Primary Examiner*—Christopher Verdier
(74) *Attorney, Agent, or Firm*—Crowell & Moring LLP

(57) ABSTRACT

In a fluidal machine with an impeller rotating to urge a fluid radially outwardly by a centrifugal force, a vane guiding the fluid discharged from the impeller, a vane member which includes a front end of the vane facing to the impeller so that the fluid discharged from the impeller strikes against the front end and which is prevented from contacting the atmosphere, and a casing surrounding the vane member and contacting the atmosphere, the vane member is discrete from the casing, a vibration propagation between the vane member and the casing is prevented or restrained, and a vibration of a pipe extending from the casing is absorbed.

5 Claims, 8 Drawing Sheets

FLUIDAL MACHINE

BACKGROUND OF THE INVENTION AND RELATED ART STATEMENT

The present invention relates to a fluid transferring or compressing machine, such as a turbo-pump, a turbo-compressor or the like.

"Kagen-kyokai-kohza 1. Pump" published from Karyoku-genshiryoku-hatsuden-gijutsu-kyokai on April, 1988 discloses on page 24 thereof that diffuser vanes, diffuser side plates and return flow vanes are fixed by welding to a laminated inner casing fixed to an outer casing in a barrel casing type turbopump.

JP-A-60-151530 discloses that rotor urging forces by fluidal pressures discharged from respective impeller stages of a rotating rotor balance each other to decrease a vibration of the fluidal machine.

It is well known that a pump is surrounded by a sound-proof cover, or a lead plate surrounds a pipe or coupling-cover.

OBJECT AND SUMMARY OF THE INVENTION

An object of the present invention is to provide a fluidal machine in which a vibration generated at a front end of a diffuser vane receiving a fluid urged by a rotating impeller is prevented or restrained from being transmitted to an outer casing contacting the atmosphere and/or to a pipe or an impeller driver motor through the outer casing.

According to the present invention, in a fluidal machine with an impeller rotating to urge a fluid radially outwardly by a centrifugal force, a vane guiding the fluid discharged from the impeller, a vane member which includes a front end of the vane facing to the impeller so that the fluid discharged from the impeller strikes against the front end and which is prevented from contacting the atmosphere, and a casing surrounding the vane member and contacting the atmosphere, at least one of the vane member and the casing has an elastically deformable portion (a compressed deformation surface spot and/or bent deformation portion of a pin, a compressed deformation surface spot of a hole receiving the pin, compressed deformation surface spots and/or bent deformation portions of joint points spaced apart from each other in a circumferential direction between the vane member and the casing, a compressed deformation part and/or bent deformation part and/or shear deformation part of an elastic member between the vane member and the casing) connected to another one of the vane member and the casing without a rigid and/or substantially monolithic connection between the vane member and casing so that a connecting rigidity between the vane member and the casing in at least one of an impeller axial direction, an impeller radial direction and an impeller circumferential direction is decreased. It is preferable that modulus of longitudinal and/or transverse elasticity or spring constant of the elastic member is less than that of the vane member and the casing. The joint points may be formed by spot welding between the vane member and the casing.

In the present invention, since the connecting rigidity (vibration transfer function) between the vane member and casing discrete from or independent of each other in at least one of an impeller axial direction, an impeller radial direction and an impeller circumferential direction is decreased by the elastically deformable portion, a vibrating deformation magnitude of the casing is kept smaller than that of the vane member so that a vibration of the vane member with the front end of the vane caused by the fluidal force discharged from the impeller is prevented or restrained from being transmitted to the casing.

In the prior art, since the vane member and the casing are fixed to each other monolithically and rigidly by a circumferentially continuous welding or a compression with screws, the elastically deformable portion is not formed between the vane member and the casing and the connecting rigidity therebetween is not decreased, that is, the vibrating deformation magnitude of the casing is substantially equal to that of the vane member and a transfer efficiency of the vibration from the vane member to the casing is significantly high.

It is preferable for improving a vibration isolation between the vane member and the casing (or an inner casing of the casing described below) that a deformation of the vane member in the impeller axial or radial direction is prevented from being restrained by the casing, that is, a clearance in the impeller axial and/or radial direction is formed between the vane member and the casing (or the inner casing of the casing) so that the vane member is slightly movable in the impeller axial and/or radial direction, and/or a spring member whose modulus of elasticity or spring constant is smaller than modulus of elasticity or spring constant of the vane member and/or the casing is arranged in the clearance to restrain or decrease a compression force in the impeller axial and/or radial direction applied to the vane member.

Substantially only the elastically deformable portion may prevent at least one of a radially outward deformation and a circumferential movement of the vane member caused by the fluid force discharged from the impeller so that the vibration of the vane member is transmitted to the casing through substantially only the elastically deformable portion.

It is preferable that the vane member is slightly movable relative to the casing in the impeller axial direction at least in a part of a temperature range of the fluidal machine during operation, and/or the vane member is slightly movable relative to the casing in at least one of the impeller radial direction and the impeller circumferential direction by the fluidal force discharged from the impeller so that the elastically deformable portion approaches the another one of the vane member and the casing when the elastically deformable portion is apart from the another one of the vane member and the casing.

It is preferable for accelerating a vibration absorption and preventing a fretting corrosion between the vane member and the casing that the vane member and the casing have respective surfaces through which the vane member and the casing contact each other, and a contacting pressure between the surfaces is limited to such a degree that the fluid exists between the surfaces.

According to the present invention, in a fluidal machine with an impeller rotating to urge a fluid radially outwardly by a centrifugal force, a vane guiding the fluid discharged from the impeller, a vane member which includes a front end of the vane facing to the impeller so that the fluid discharged from the impeller strikes against the front end and which is prevented from contacting the atmosphere, and a casing surrounding the vane member and contacting the atmosphere, the vane member is discrete from the casing without a rigid and/or substantially monolithic connection there between, and a deformation of the vane member in at least one of an impeller axial direction and the impeller radial direction is prevented from being restrained by the casing.

In the present invention, since the deformation of the vane member in the at least one of an impeller axial direction and the impeller radial direction is prevented from being restrained by the casing, the deformation of the vane member is independent of that of the casing so that the vibration isolation between the vane member and the casing is formed.

In a fluidal machine with an impeller rotating to urge a fluid radially outwardly by a centrifugal force, a vane guiding the fluid discharged from the impeller, a vane member which includes a front end of the vane facing to the impeller so that the fluid discharged from the impeller strikes against the front end and which is prevented from contacting the atmosphere, and a casing surrounding the vane member and contacting the atmosphere, the vane member is discrete from the casing, and at least one of a radial movement and a circumferential movement of the vane member caused by the fluid force discharged from the impeller is prevented by the casing through substantially only one axial side of the vane member without a substantially monolithic and/or rigid connection between the one axial side of the vane member and the casing.

In the present invention, since at least one of a radial movement and a circumferential movement of the vane member caused by the fluid force discharged from the impeller is prevented by the casing through substantially only the one axial side of the vane member, a contacting area or connecting cross section between the vane member and the casing is kept small to decrease or throttle a vibration propagation from the vane member to the casing.

In the prior art, since the vane member and the casing are fixed monolithically and rigidly to each other through both axial sides of the vane member by the circumferentially continuous welding or compressing with the screws, the contacting area between the vane member and the casing is large so that a vibration propagation efficiency from the vane member to the casing is high.

The elastic member more softly deformable in comparison with the vane member and/or the casing in at least one of the impeller radial direction, the impeller axial direction and the impeller circumferential direction may be arranged between the vane member and the casing.

According to the present invention, in a fluidal machine with an impeller rotating to urge a fluid radially outwardly by a centrifugal force, a vane guiding the fluid discharged from the impeller, a vane member which includes a front end of the vane facing to the impeller so that the fluid discharged from the impeller strikes against the front end and which is prevented from contacting the atmosphere, and a casing surrounding the vane member and contacting the atmosphere, the vane member is discrete from the casing, and the casing has an outer casing contacting the atmosphere and an inner casing which is surrounded by the outer casing, is prevented from contacting the atmosphere, is arranged between the vane member and the outer casing and contacts the vane member, the inner casing is discrete from the outer casing without a rigid and/or substantially monolithic connection therebetween, and the vane member is discrete from the inner casing without a rigid and/or substantially monolithic connection therebetween.

In the present invention, since the inner casing contacting the vane member is discrete from the outer casing contacting the atmosphere and the vane member is discrete from the inner casing, a contact without monolithic and rigid connection between the inner casing and the vane member is formed between the vane member and the atmosphere so that the inner casing is isolated from the vibration of the vane member by the contact without monolithic and rigid connection.

An axial and/or radial deformation of the vane member may be substantially prevented from being restrained by the inner casing.

The substantially monolithic connection means non-spot continuous welding connection, tight and interference fitting, strong pressing against each other, or the like.

DETAILED DESCRIPTION OF PREFERRED EMBODIMENTS

Figure 1:
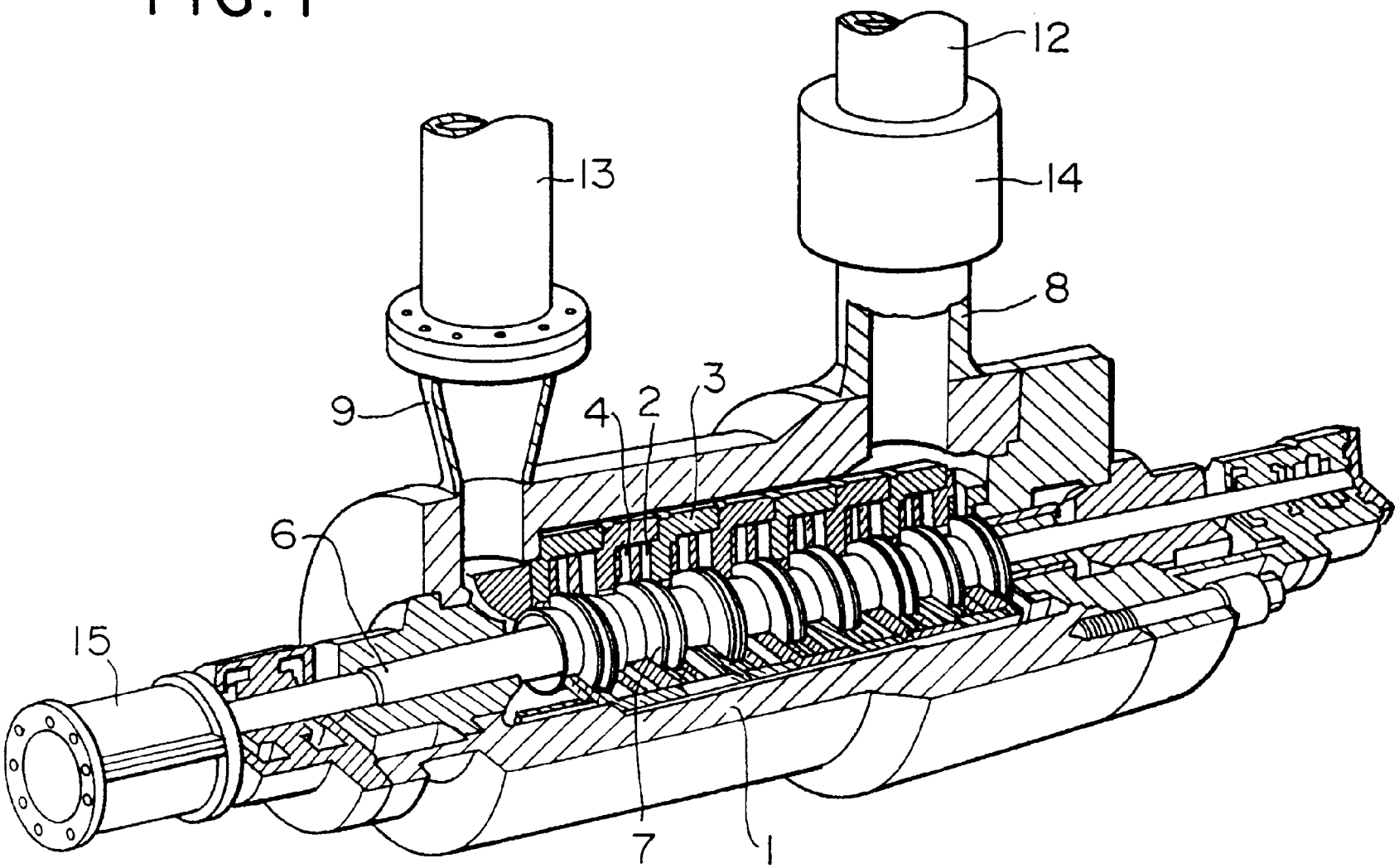
FIG. 1 is a partially cross sectional view showing a fluidal machine of the present invention.

In a barrel casing type turbine pump as shown in FIG. 1, an outer casing 1 contacting the atmosphere as a part of the claimed casing surrounds a laminated inner casing 3 as another part of the claimed casing, and the inner casing 3 surrounds vane members 4 including diffuser vanes 4*a* with respective front ends facing to an impeller 7 and return flow vanes 2 as the claimed vane member without contact with the atmosphere. The inner casing 3 surrounding the vane members 4 may directly contact the atmosphere as the claimed casing. The impeller (pump turbine) 7 is arranged at a radially inner side of the vane members 4 and is rotated through a rotational shaft 6 by an impeller driver motor with a driver housing 24 and a driver shaft 25. The laminated inner casing 3 is axially compressed against the outer casing 1 to be fixed thereto.

A suction pipe 13 with relatively small thickness is connected to the outer casing through an inlet nozzle 9 so that a fluid is supplied to the rotating impeller 7 to be urged radially and circumferentially thereby. Kinetic energy of the fluid discharged from the impeller 7 is converted to pressure potential thereof by a diffuser space expanding along a radially outward and circumferential flow of the fluid between the diffuser vanes 4*a*, and subsequently the fluid is directed to a radially inward direction toward the impeller 7 by the return flow vanes 2. The pressurized fluid flowing out finally from the impeller 7 is supplied to an outlet pipe 12 as a part of the claimed pipe with relatively large thickness through an outlet nozzle 8 as another part of the claimed pipe.

Figure 11:
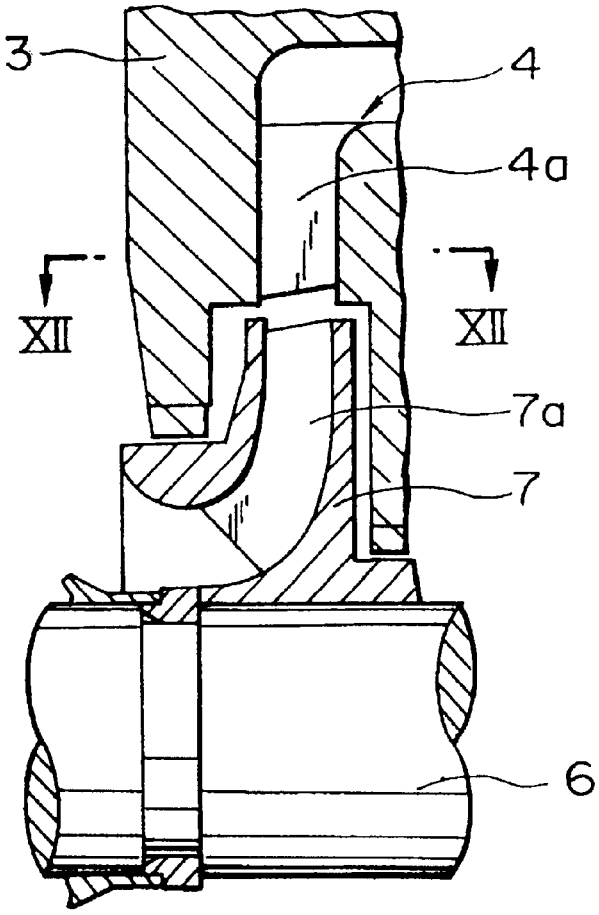
FIG. 11 is a cross sectional showing an impeller and a diffuser vane member preferable for the present invention.
Figure 12:
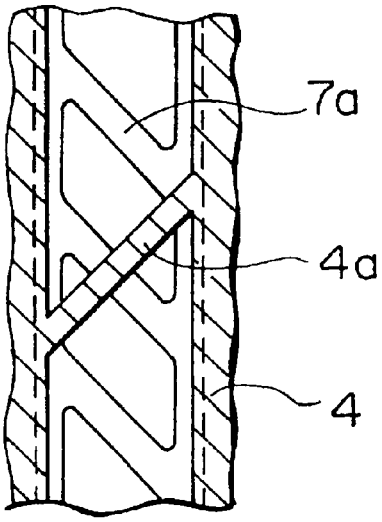
FIG. 12 is a cross sectional view showing an impeller vane and a diffuser vane as seen in a radial direction.

Outer periphery of the impeller 7 and inner periphery (the front end) of the diffuser vanes 4 facing to each other may be inclined relative to a rotational axis of the impeller 7 as shown in FIG. 11. Impeller vanes 7*a* and the diffuser vanes 4 facing to each other may cross each other as shown in FIG. 12 so that a fluidal striking force against the front ends of the diffuser vanes 4 is decreased and a vibration of fluidal machine caused by the fluidal striking force against the front ends of the diffuser vanes 4 is restrained.

Figure 2:
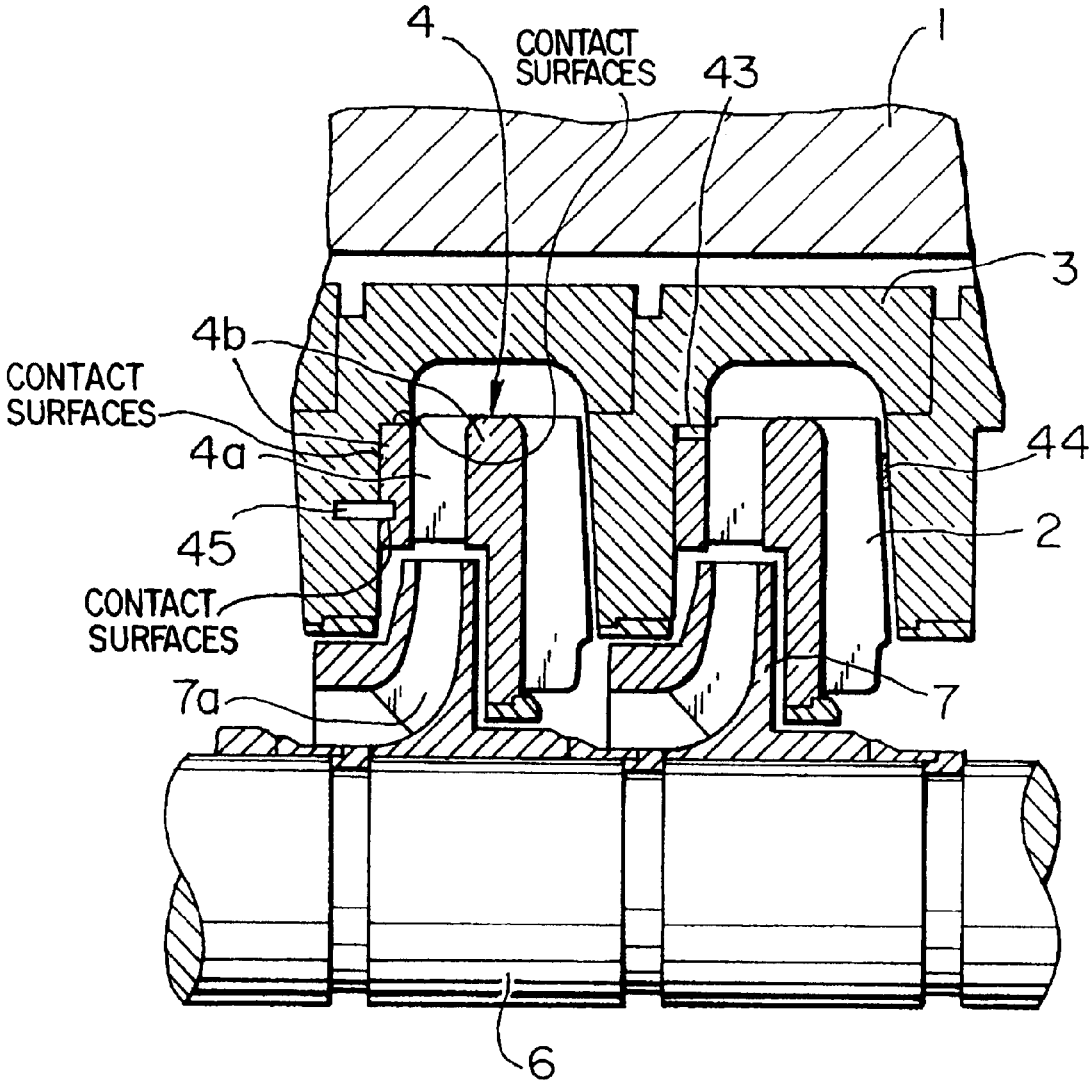
FIG. 2 is a cross sectional view showing a separation and connection structure between a casing and a vane member.

As shown in FIG. 2, each of the vane members 4 has an integral or monolithic combination of the diffuser vanes 4*a*, the return flow vanes 2 and side plates 4*b*, and is discrete or separated from the inner casing 3 so that a vibration propagation is isolated at a separation between the each of the vane members 4 and the inner casing 3. Contact or fitting area between each of the vane members 4 and the inner casing 3 for preventing a radial movement of each of the vane members 4 may be formed at only one axial side of each of the vane members 4 so that a cross section or surface area for vibration propagation from the vane members 4 to the inner casing 3 is kept small. At least one of a radial movement and a circumferential movement of the vane members 4 relative to the inner casing 3 is restrained by pins 45. It is preferable that the at least one of a radial movement and a circumferential movement of the vane members 4 is kept as small as possible. The contact area between each of the vane members 4 and the inner casing 3 for preventing the radial movement of each of the vane members 4 may be divided to a plurality of joint portions 43 spaced apart circumferentially from each other. An elastic member or spring 44 as the claimed softly deformable elastic member and/or the claimed elastically deformable portion may be arranged between the inner casing 3 and each of the vane members 4.

Figure 3:
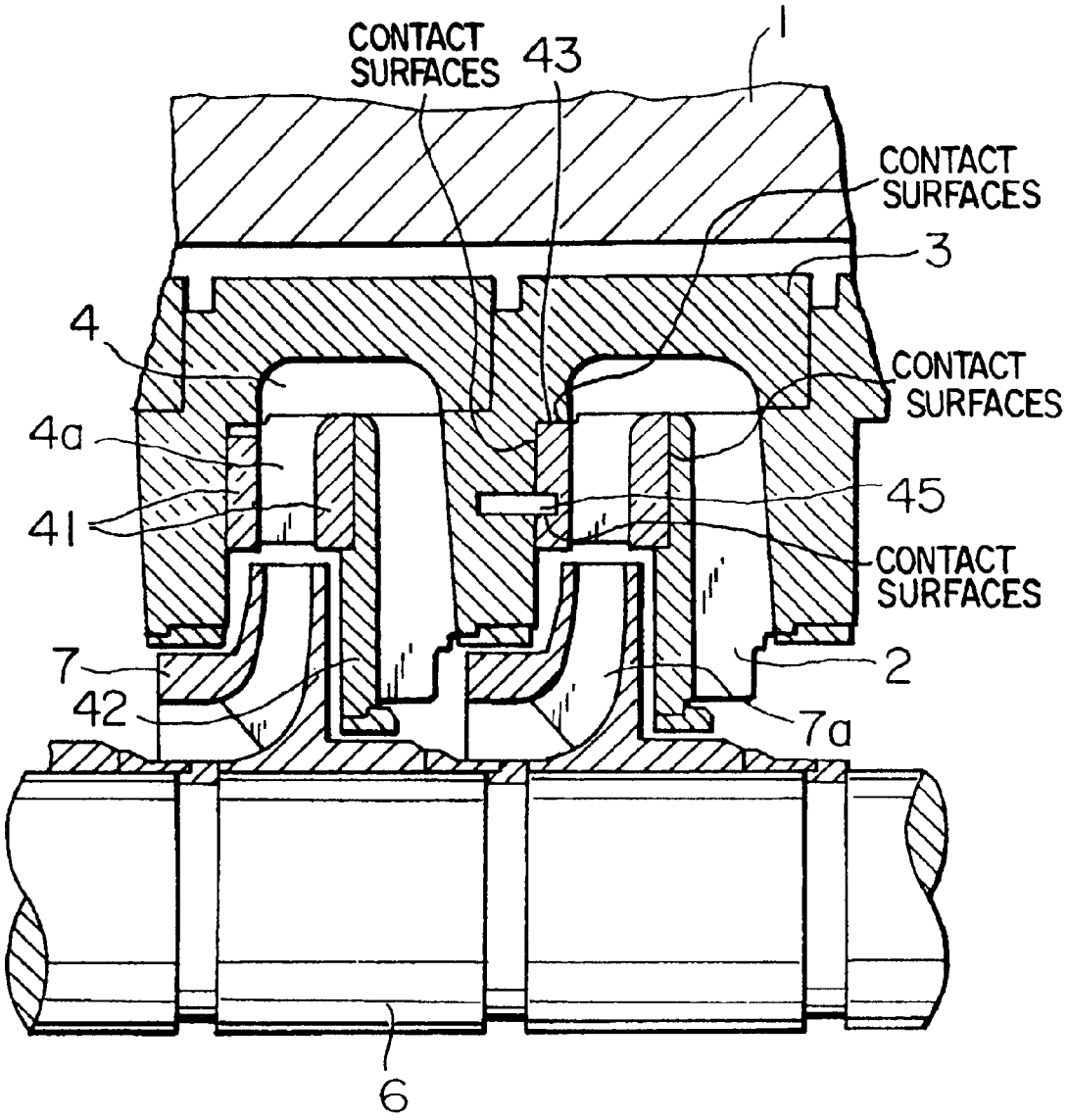
FIG. 3 is a cross sectional view showing another separation and connection structure between a casing and a vane member.

In the vane members 4 as shown in FIG. 3, each of the side plates 4*b* is divided to a diffuser portion 41 and a return flow portion 42 so that each of the vane members 4 is divided to a monolithic combination of the diffuser portion 41 and the diffuser vanes 4*a*, (as the claimed vane member) and another monolithic combination of the return flow portion 42 and the return flow vanes 2 so that a mass vibrated directly by the fluidal force is kept small. The another monolithic combination of the return flow portion 42 and the return flow vanes 2 may be fixed monolithically to the inner casing 3 as non-claimed vane member. Connection between the monolithic combination of the diffuser portion 41 and the diffuser vanes 4*a* and the inner casing 3 is similar to FIG. 2.

As shown in FIG. 1, a vibration absorber 14 is arranged on the outlet pipe 12 and/or the outlet nozzle 8 so that the vibration propagation from the outer casing 1 to the outlet pipe 12 is restrained.

Figure 4:
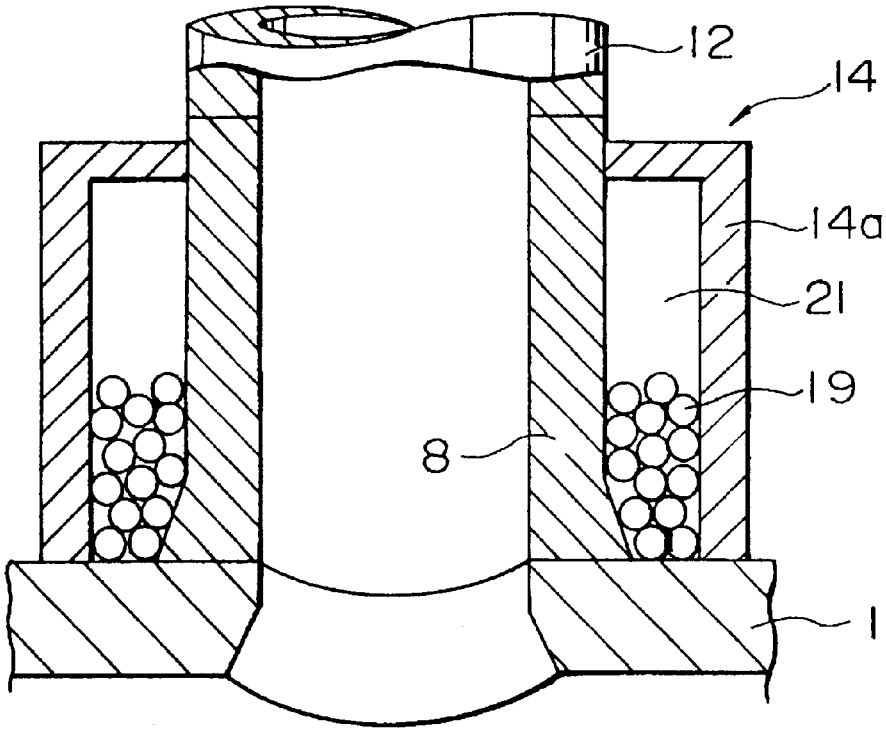
FIG. 4 is a partially cross sectional view showing a vibration absorber on a pipe.

The vibration absorber 14 as shown in FIG. 4 has a body 14*a* forming a space 21, and grains 19 which are movable relative to each other, are made of a high specific-gravity and viscoelasticity material, for example, lead and are received by the space 21.

Figure 5:
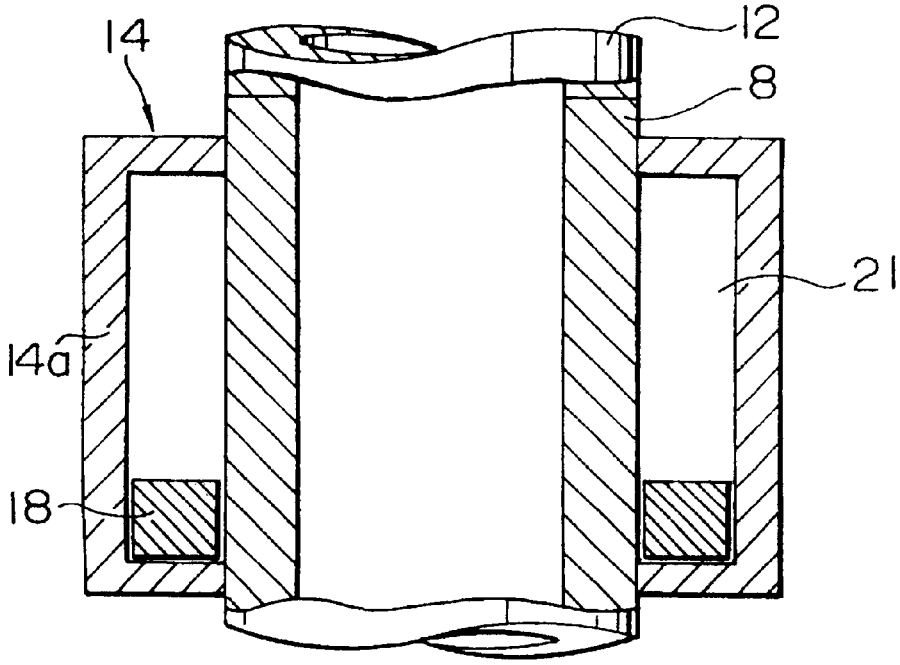
FIG. 5 is a partially cross sectional view showing another vibration absorber on a pipe.

The vibration absorber 14 as shown in FIG. 5 has in the space 21 a ring-shaped mass damper 18 made of the high specific-gravity and viscoelasticity material, for example, lead.

Figure 6:
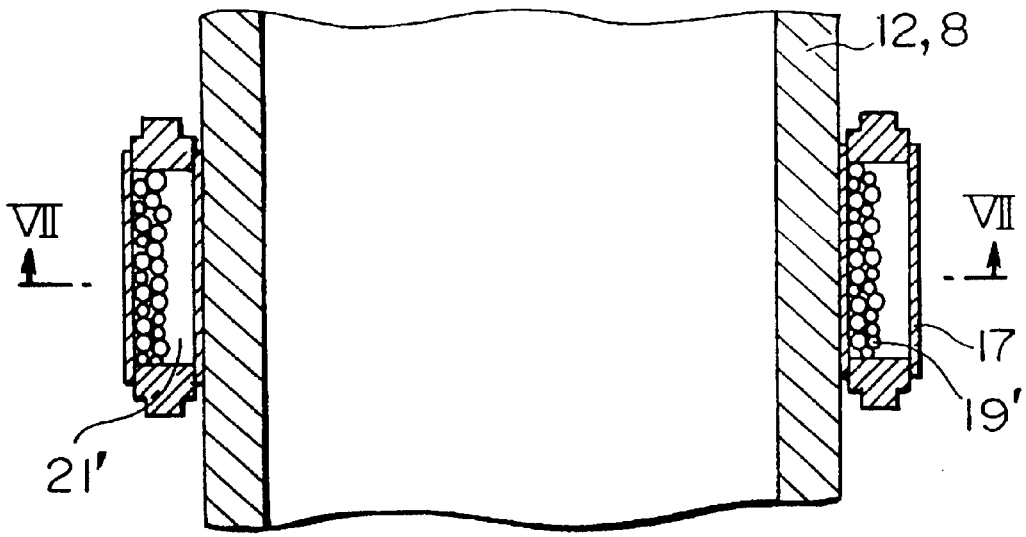
FIG. 6 is a partially cross sectional view showing another vibration absorber on a pipe.
Figure 7:
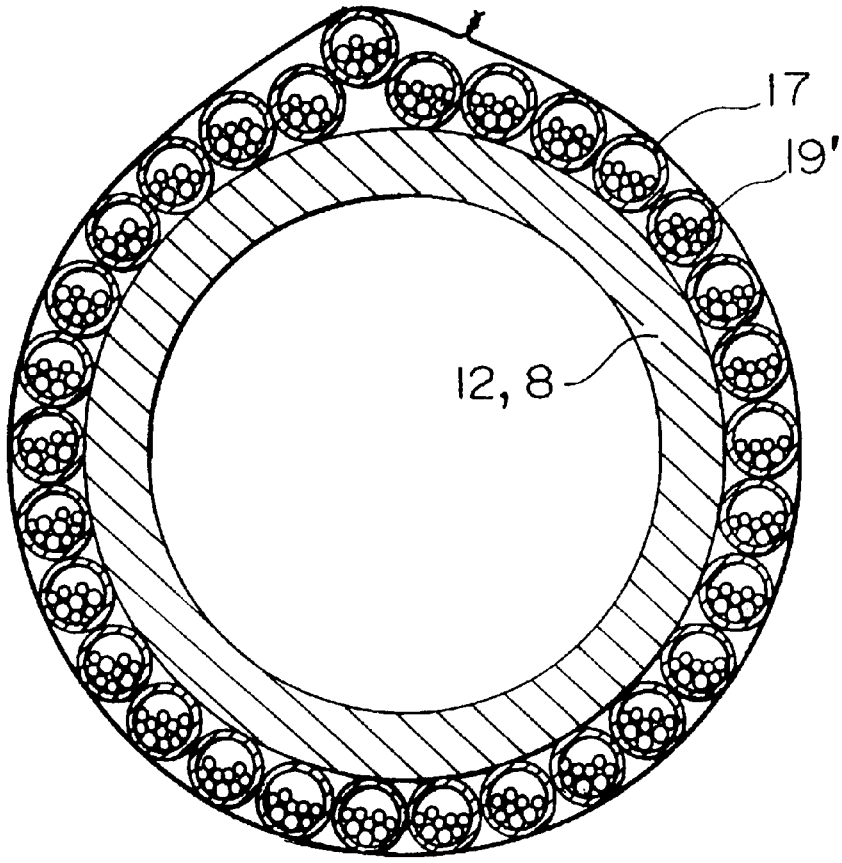
FIG. 7 is a cross sectional view of the vibration absorber of FIG. 6 as seen from a pipe longitudinal direction.

As shown in FIGS. 6 and 7, a plurality of vibration absorbers each of which includes a cylindrical container 17 and discrete grains 19' movable relative to each other and made of the high specific-gravity and viscoelasticity material, for example, lead are arranged on the outlet pipe 12 and/or the outlet nozzle 8. The cylindrical containers 17 are compressed against or welded to the outlet pipe 12 and/or the outlet nozzle 8.

Figure 8:
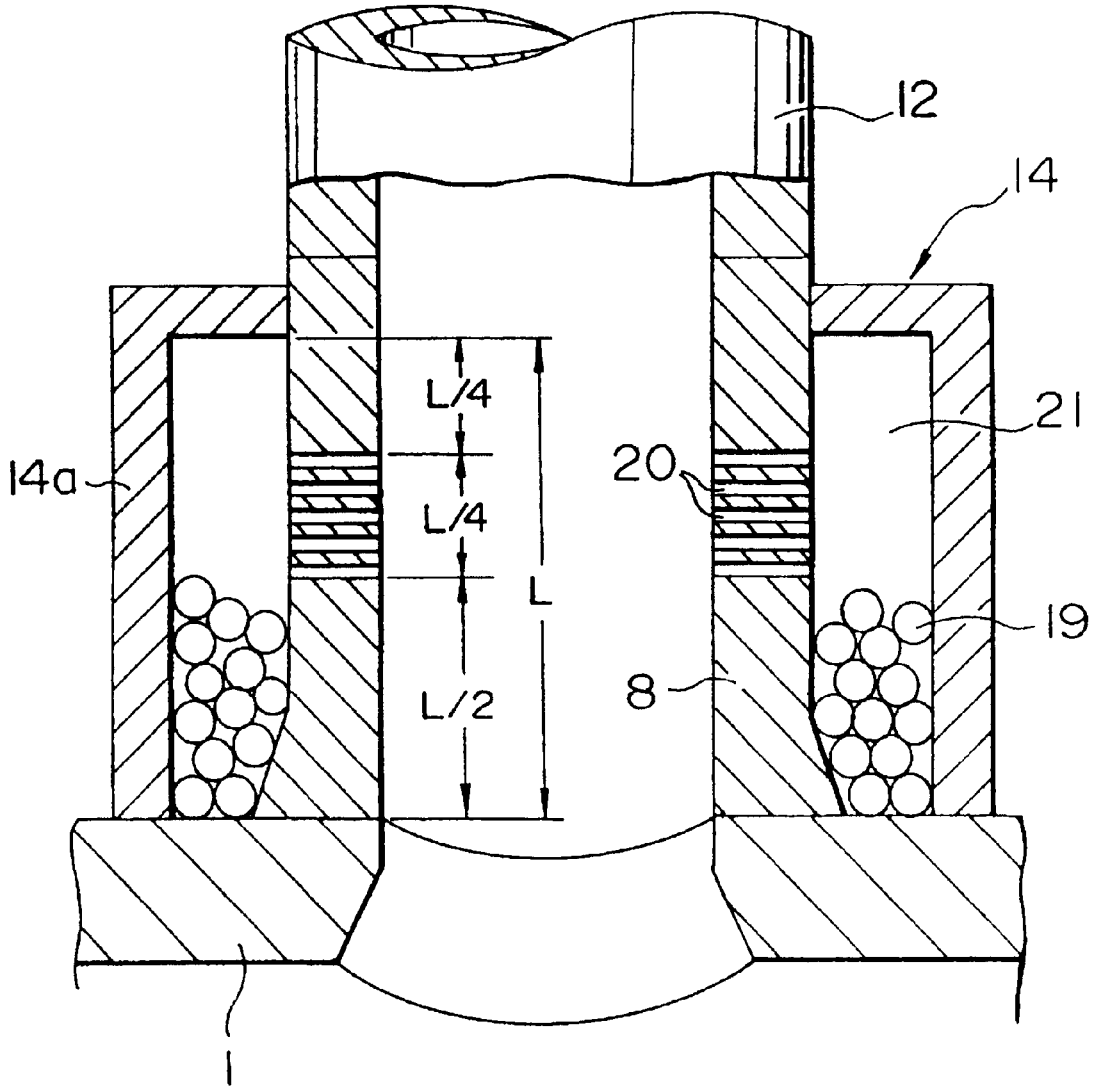
FIG. 8 is a partially cross sectional view showing another vibration absorber on a pipe.

The vibration absorber 14 as shown in FIG. 8 arranged on the outlet pipe 12 and/or the outlet nozzle 8 has the body 14*a*, the space 21, the grains 19 and throttle holes 20 for fluidal communication between an inside of the outlet pipe 12 and/or the outlet nozzle 8 and the space 21. Fluidal pressure waves are introduced into the space 21 to be reflected by outer surfaces of the grains 19 and inner surface of the space 21 so that the fluidal pressure waves interfere with each other to be absorbed in the space 21.

Figure 9:
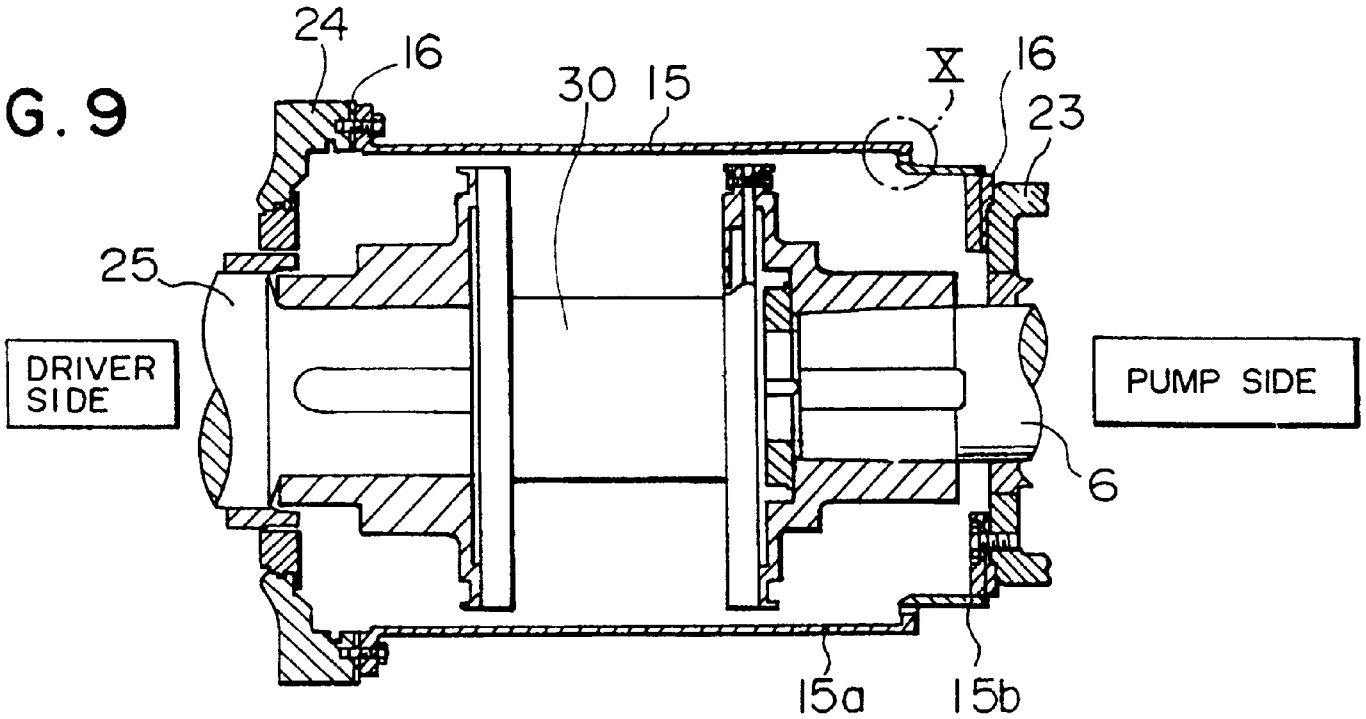
FIG. 9 is a cross sectional view showing a coupling for preventing a vibration propagation from a casing to an impeller driver.
Figure 10:
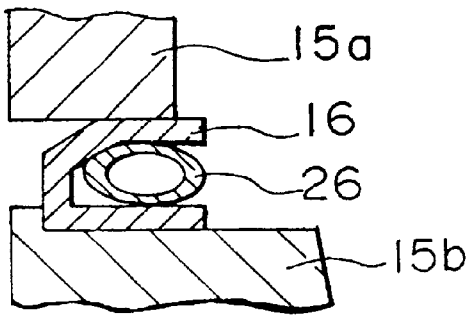
FIG. 10 is an enlarged cross sectional view of X portion in FIG. 9.

A coupling cover 15 for covering a coupling 30 connecting the rotational shaft 6 and the impeller driver shaft 25 has an end connected to the driver housing 24 and another end connected to a fluidal machine housing 23, and is composed of a driver side cover 15*a* and a fluidal machine side cover 15*b*, as shown in FIG. 9. The driver side cover 15*a* and the fluidal machine side cover 15*b* are connected to each other by a viscoelastic member 16 made of, for example, oil-resistant and heat-resistant rubber, and a ring-shaped spring 26 compresses the viscoelastic member 16 against the driver side cover 15*a* and the fluidal machine side cover 15*b* as shown in FIG. 10. The viscoelastic member 16 may be adhered to the whole surface of the coupling cover 15 to form a vibration absorber plate. The coupling cover 15 and at least one of the driver housing 24 and the fluidal machine housing 23 may be connected to each other through the viscoelastic member 16. The viscoelastic member 16 absorbs the vibration of the coupling cover 15 to prevent the vibration from being transmitted from the fluidal machine housing 23 through the viscoelastic member 16 to the driver housing 24, and a distance change between the driver housing 24 and the fluidal machine housing 23 caused by temperature variation.

What is claimed is:

1. A fluidal machine comprising:

an impeller rotationally arranged to urge a fluid radially outwardly by a centrifugal force, a plurality of vane members configured to the fluid discharged from the impeller, including a first vane member, each of the vane members comprising a front end arranged to face the impeller so that the fluid discharged from the impeller strikes against the front end and which is prevented from communicating with atmosphere, and a casing surrounding the vane members and communicating with the atmosphere, wherein at least one of the first vane member and the casing has an elastically deformable portion connected to the other of the first vane member and the casing to obtain a decreased connecting rigidity between the first vane member and the casing in at least one of an impeller axial direction, an impeller radial direction and an impeller circumferential direction, and wherein the at least one of the first vane member and the casing has a pin connected to the other of the first vane member and the casing, and the pin includes the elastically deformable portion through which a deformation of the vane member is transmitted to the casing.

2. A fluidal machine comprising:

an impeller rotationally arranged to urge a fluid radially outwardly by a centrifugal force, a plurality of vane members configured to the fluid discharged from the impeller, including a first vane member, each of the vane members comprising a front end arranged to face the impeller so that the fluid discharged from the impeller strikes against the front end and which is prevented from communicating with atmosphere, and a casing surrounding the vane members and communicating with the atmosphere, wherein at least one of the first vane member and the casing has an elastically deformable portion connected to the other of the first vane member and the casing to obtain a decreased connecting rigidity between the first vane member and the casing in at least one of an impeller axial direction, an impeller radial direction and an impeller circumferential direction, and wherein the at least one of the first vane member and the casing has a plurality of connecting points connected to the other of the vane member and the casing and spaced apart from each other in the impeller circumferential direction, and the connecting points include the elastically deformable portion through which a deformation of the vane member is transmitted to the casing.

3. A fluidal machine comprising:

an impeller rotationally arranged to urge a fluid radially outwardly by a centrifugal force, a plurality of vane members configured to the fluid discharged from the impeller, including a first vane member, each of the vane members comprising a front end arranged to face the impeller so that the fluid discharged from the impeller strikes against the front end and which is prevented from communicating with atmosphere, and a casing surrounding the vane members and communicating with the atmosphere, wherein at least one of the first vane member and the casing has an elastically deformable portion connected to the other of the first vane member and the casing to obtain a decreased connecting rigidity between the first vane member and the casing in at least one of an impeller axial direction, an impeller radial direction and an impeller circumferential direction, and wherein substantially only the elastically deformable portion prevents at least one of a radially outward deformation and a circumferential movement of the first vane member caused by the fluid force discharged from the impeller.

4. A fluidal machine comprising:

an impeller rotationally arranged to urge a fluid radially outwardly by a centrifugal force, a plurality of vane members configured to the fluid discharged from the impeller, including a first vane member, each of the vane members comprising a front end arranged to face the impeller so that the fluid discharged from the impeller strikes against the front end and which is prevented from communicating with atmosphere, and a casing surrounding the vane members and communicating with the atmosphere, wherein at least one of the first vane member and the casing has an elastically deformable portion connected to the other of the first vane member and the casing to obtain a decreased connecting rigidity between the first vane member and the casing in at least one of an impeller axial direction, an impeller radial direction and an impeller circumferential direction, and wherein the first vane member is movable to a predetermined extent relative to the casing in at least one of the impeller radial direction and the impeller circumferential direction by the fluidal force discharged from the impeller so that the elastically deformable portion approaches the other of the first vane member and the casing when the elestically deformable portion is apart from the other of the first vane member and the casing.

5. A fluidal machine comprising:

an impeller rotationally arranged to urge a fluid radially outwardly by a centrifugal force, a plurality of vane members configured to the fluid discharged from the impeller, including a first vane member, each of the vane members comprising a front end arranged to face the impeller so that the fluid discharged from the impeller strikes against the front end and which is prevented from communicating with atmosphere, and a casing surrounding the vane members and communicating with the atmosphere, wherein at least one of the first vane member and the casing has an elastically deformable portion connected to the other of the first vane member and the casing to obtain a decreased connecting rigidity between the first vane member and the casing in at least one of an impeller axial direction, an impeller radial direction and an impeller circumferential direction, and wherein the first vane member and the casing have respective surfaces through which the first vane member and the casing contact each other, and a contacting pressure between the surfaces is limited to such a degree that the fluid exists between the surfaces.

* * * * *